US007671783B2

(12) United States Patent
Carcone

(10) Patent No.: US 7,671,783 B2
(45) Date of Patent: Mar. 2, 2010

(54) RADAR REFLECTOR

(75) Inventor: John M. Carcone, Portsmouth, RI (US)

(73) Assignee: Raytheon Company, Waltham, MA (US)

( * ) Notice: Subject to any disclaimer, the term of this patent is extended or adjusted under 35 U.S.C. 154(b) by 279 days.

(21) Appl. No.: 11/601,938

(22) Filed: Nov. 20, 2006

(65) Prior Publication Data

US 2009/0207066 A1 Aug. 20, 2009

(51) Int. Cl.
*H01Q 15/00* (2006.01)

(52) U.S. Cl. ..... 342/9; 342/5; 342/8

(58) Field of Classification Search ..... 342/5–12
See application file for complete search history.

(56) References Cited

U.S. PATENT DOCUMENTS 2,534,710 A * 12/1950 Golian et al. ..... 441/20
3,938,151 A * 2/1976 Trenam ..... 342/10
3,952,694 A * 4/1976 McDonald ..... 116/209
3,959,766 A 5/1976 Nees et al.
4,152,933 A * 5/1979 Woodhouse ..... 73/170.07
4,215,862 A 8/1980 Yoshikawa et al.
4,890,568 A * 1/1990 Dolengowski ..... 114/246
5,061,929 A 10/1991 Bell
5,421,287 A * 6/1995 Yonover ..... 116/209
5,530,445 A 6/1996 Veazey
5,838,275 A 11/1998 Carmi
5,906,199 A * 5/1999 Budzinski ..... 128/201.11
6,225,940 B1 5/2001 Ohlsen
6,384,764 B1 * 5/2002 Cumberland ..... 342/8
6,496,447 B1 * 12/2002 Gabriel ..... 367/1
6,570,545 B1 5/2003 Snow
6,784,825 B1 8/2004 Kubota
6,845,728 B1 * 1/2005 Horton ..... 114/244
6,864,858 B1 3/2005 Miller et al.

* cited by examiner

*Primary Examiner*—Thomas H Tarcza
*Assistant Examiner*—Timothy A Brainard
(74) *Attorney, Agent, or Firm*—Daly, Crowley, Mofford & Durkee, LLP

(57) ABSTRACT

A submarine warfare radar training system 10 includes an underwater vehicle 15 towing a float device 40 and a radar reflective target 45. The radar reflective target 45 is configured as a hollow tube-shaped element 50 having circular open leading and trailing open circular end to allow water to flow through the target as it is towed. The target 45 includes a positive buoyancy material layer 60 and is horizontally oriented during towing. The float device 40 is configured to support the radar reflective target 45 open leading end above the water surface 30 as the float device 40 and radar reflective target 45 are towed along the water surface to deliver air into the hollow cross-section. The radar reflective target 45 has an adjustable RCS which can be increased or decreased by lengthening or shortening the radar reflective target.

16 Claims, 8 Drawing Sheets

RADAR REFLECTOR

The United States Government has rights in this invention pursuant to Contract No. N00024-96-C-6106 awarded by the Department of the Navy.

BACKGROUND OF THE INVENTION

1. Field of the Invention

The present invention relates to a radar reflective target capable of being detected by aircraft x-band radar. In particular, the radar reflective target is a light weight low cost device configured to be towed through water as a radar training target or to float stationary on water as an aid to increase the radar visibility of a distressed person.

2. Description of the Related Art

In a submarine warfare training applications it is known to deploy a device in the water to simulate a submarine periscope mast extended above the water in order to train radar operators to find small radar targets. A submarine mast simulator is shown by Horton in U.S. Pat. No. 6,845,728, entitled TOWABLE SUBMARINE MAST SIMULATOR. Horton describes a tow body formed by a hydrodynamically shaped hollow shell formed with a nose, a tail and a plurality of stabilizer fins extending radially from the tail. The shell shape and stabilizer fins are configured to minimize drag and to stabilize the orientation of the tow body as it is towed by an unmanned underwater vehicle (UUV). The shell attaches to the UUV underwater vehicle by a tow line or cable to tow the shell at a desired speed, along the water surface, or submerged at a desired depth below the water surface.

Horton's tow body is equipped with a variety of submarine simulating features including a simulated submarine mast that generates a wake in the water and provides a visual and radar profile similar to that of a submarine mast extended above the water. The tow body also includes a combustion chamber that generates simulated infrared and chemical vapor emissions of a submarine. The simulated submarine mast includes a rigid but hollow cylindrical lower portion pivotally attached to the shell. The mast upper portion comprises an inflatable elastomeric tube that is filled by air to deploy the mast visual and radar simulator element vertically extended above the water surface. In a non-operating position the mast upper portion is deflated and coiled and the mast lower portion pivoted to a horizontal orientation for storage inside the shell. However, the submarine mast simulator described by Horton is complex and costly. It includes a mast pivoting motor and gears, an air pump to inflate the elastomeric tube and numerous automated electrical and mechanical control elements to raise and lower the mast as required. Much of the complexity of the Horton device relates to vertically extending the radar target above the water. Meanwhile, there is a need for a simpler lower cost device.

In another example, a target training device is shown by Yoshikawa et al. in U.S. Pat. No. 4,215,862, entitled WATER SURFACE TOWED TARGET. Yoshikawa et al. describe a towed target formed by a torpedo shaped underwater towed member supporting a target pole or mast extending above the water surface. The towed member is towed by a ship and the target pole includes a spherical radar reflector (Lunenburg lens) supported at its top end. In order to stabilize the towing characteristics of the Yoshikawa et al. device and particularly to keep the mast vertically oriented, the towed member is configured with a submerged ballast weight, a plurality of target support and stabilizing members. Again, much of the complexity of the Yoshikawa et al. device relates to vertically extending the radar target above the water.

Applicants have recognized that a radar target disposed substantially horizontally along the water surface can be detected by an airborne radar system and may be used to train airborne radar operators in submarine warfare. This realization allows the use of a simplified and less costly radar target to simulate the radar cross-section of a submarine mast but without the need to support the target vertically extended above the water surface. In addition, there is a need in the art of submarine warfare training to provide a submerged radar target, e.g. being towed at a submerged depth of 100 feet below the water surface and this need is not addressed by in the prior art.

A horizontally disposed radar target is disclosed by Yonover in U.S. Pat. No. 5,421,287 entitled VISUAL LOCATING DEVICE FOR PERSONS LOST AT SEA OR THE LIKE. Yonover discloses a streamer rolled up for storage and attached to a flotation device such as might be worn by a distressed person in water. The streamer is formed of a thin polyethylene material outstretched flat on the water surface. The streamer is coated with one or more materials selected to make the streamer visible from an aircraft. However, even if the streamer of Yonover had radar reflective material, it would not be effective for detection by radar in an airplane because the streamer is essentially flat resting on the water surface with water flowing over it.

SUMMARY OF THE INVENTION

The present invention overcomes the problems cited in the prior art by providing a radar target system which includes a radar reflective target formed by a hollow tube-shaped radar reflective element. The tube-shaped element is formed with circular cross-section having an open leading end and an open trailing end. The target includes an attaching element attached to the open leading end of the tube-shaped element and secured to a float device that is configured to be towed along the surface of a body of water or that may be towed submerged under the water.

The float device includes a cylindrical float section comprising a positive buoyancy material. A conical nose portion attaches to the float section at the leading end thereof facing a tow direction. A conical tail portion attaches to the float section at its trailing end. The float device includes a plurality of stabilizer fins attached to the conical tail portion and extending radially outward. The stabilizing fins orient and stabilized the float device as it is being towed.

The float device includes a tow line attaching element for connecting to a tow line. The attaching element is positioned to provide a desired towing performance as the float device and radar reflective target are towed in through the water. The attaching element attached to the tube-shaped element at its leading open end is configured to maintain the circular cross-section of the leading open end as the float device and radar reflective target are towed in water. The float device also includes an attaching member secured at its trailing end for attaching the hollow tube-shaped radar reflective target to the float device.

The float device and attached hollow reflective radar reflective radar target are secured to an underwater vehicle by a tow line. The underwater vehicle, which may be manned or unmanned, tows the float device and attached radar target. The float and target may be towed along the water surface or submerged. Air enters the hollow reflective radar target which assists in providing buoyancy. When the float device is submerged, water fills the hollow reflective radar target which assists with the sinking. The system may also include an acoustic array configured to emit an acoustic signature that simulates the sound made by a submarine. The array is disposed between the underwater vehicle and the tow line. The float device may also be configured with a box-shaped hollow storage area attached to its trailing end to extend its longitudinal length. The box may be used to store one or more radar targets with hollow tube-shaped elements in a collapsed state. The float device is also configured to support the hollow tube-shaped radar reflective target open leading end above the water surface as the float device and radar reflective target are towed in water. Generally, the hollow tube-shaped radar reflective target has an adjustable RCS which may be increased or decreased by lengthening or shortening the radar reflective target.

BRIEF DESCRIPTION OF THE DRAWINGS

The features of the present invention will best be understood from a detailed description of the invention and a preferred embodiment thereof selected for the purposes of illustration and shown in the accompanying drawings in which.

DESCRIPTION OF THE PREFERRED EMBODIMENTS

Radar Target System

Figure 1:
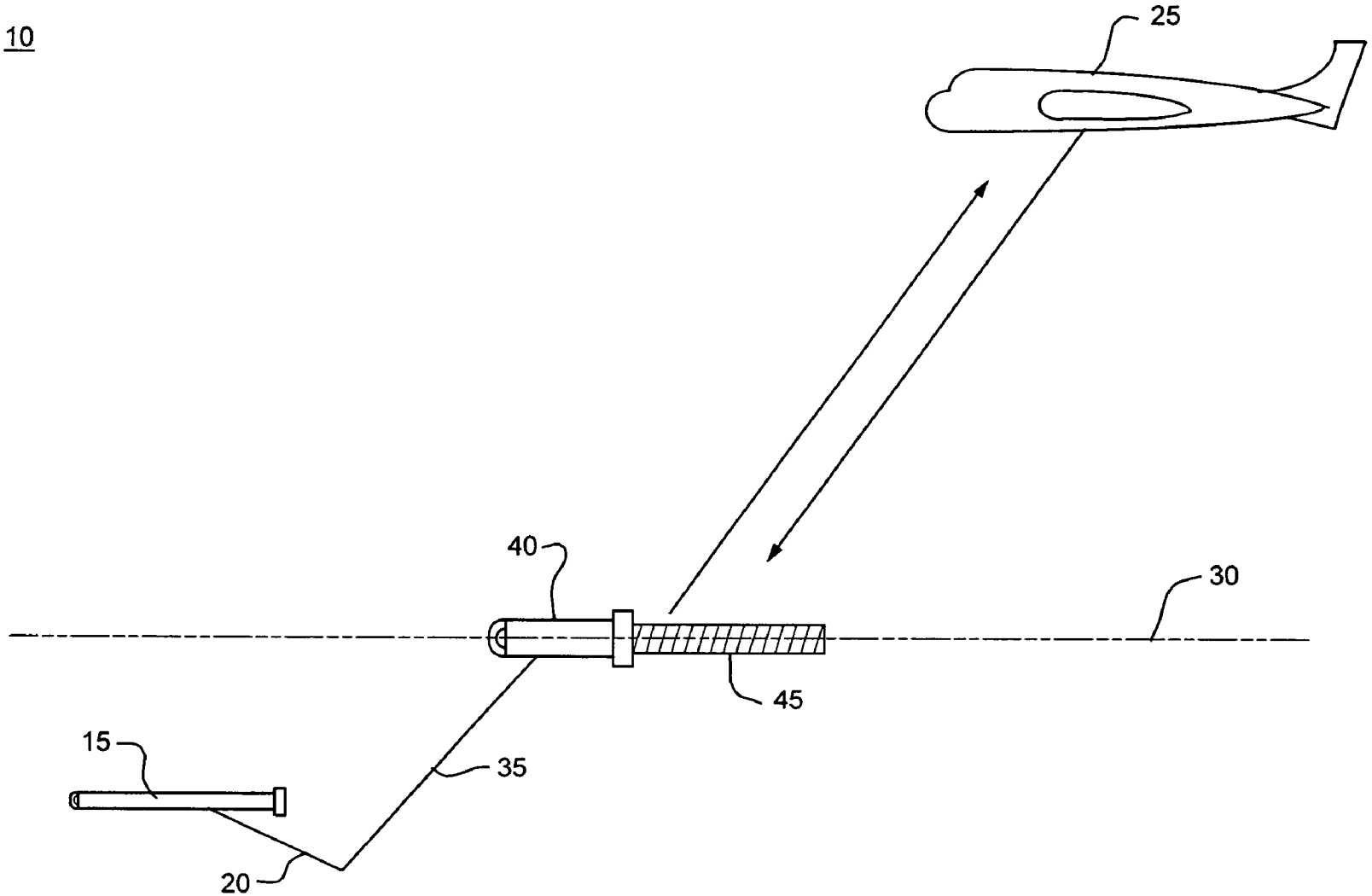
FIG. 1 illustrates a submarine warfare training target system presenting a tube-shaped radar target on a water body surface according to the present invention.
Figure 2:
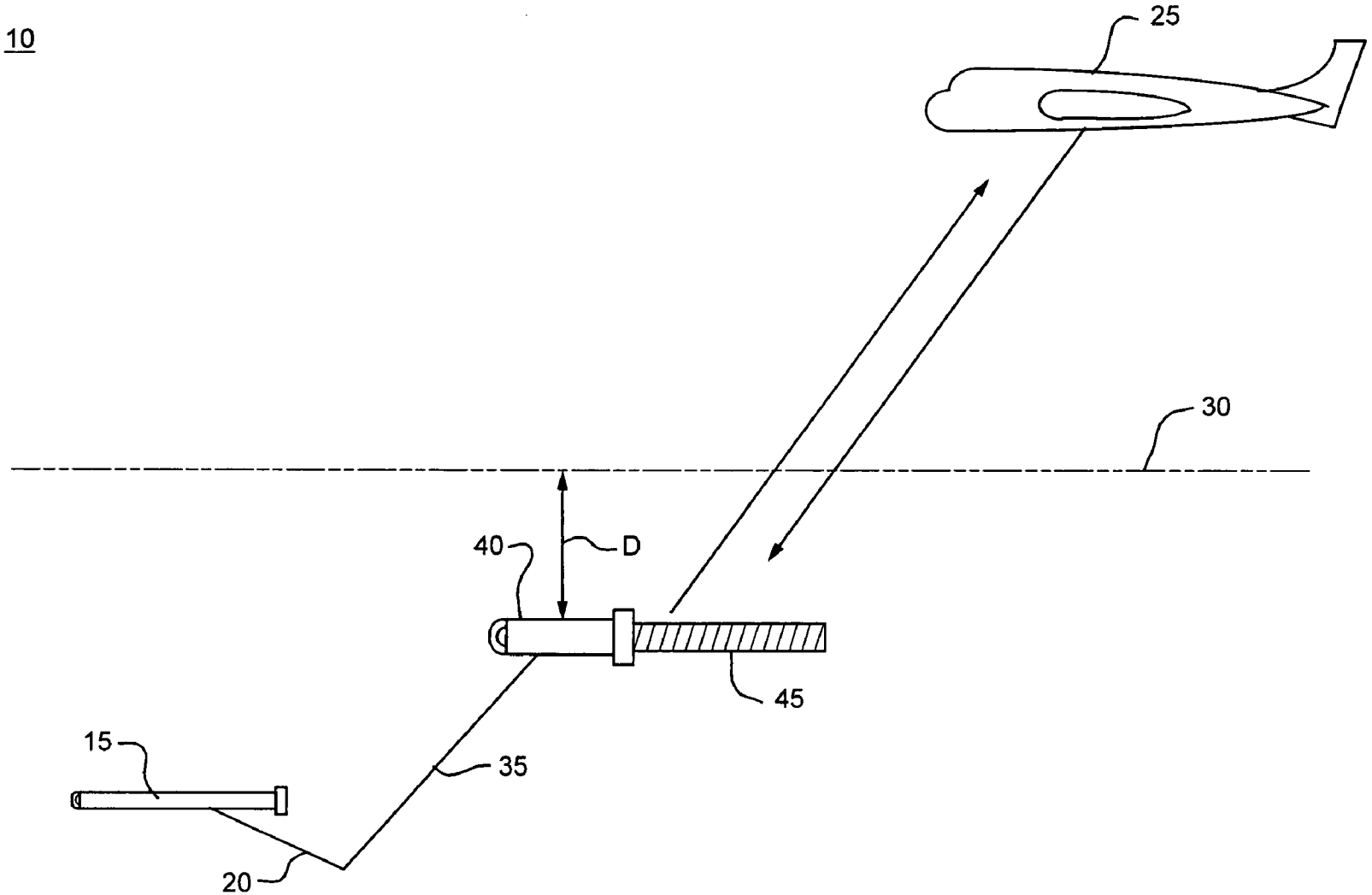
FIG. 2 illustrates a submarine warfare training target system presenting a tube-shaped radar target submerged under a water body surface according to the present invention.

A target system 10, according to one embodiment of the present invention, is shown in FIGS. 1 and 2. The target system 10 includes a submerged manned or unmanned underwater vehicle, 15 programmed to move at one or more desired depths, velocities and patterns of movement. The underwater vehicle 15 may be remotely controlled from a base station, not shown, e.g. by radio communication from a surface marine vessel, aircraft, land installation, or submarine vessel. Alternately, the underwater vehicle 15 may operate autonomously according to predefined program sequences.

In a preferred embodiment, the underwater vehicle 15 tows an acoustic array 20. The acoustic array 20 is configured to emit an acoustic signature that simulates the sound made by a submarine. The acoustic signature is sensed by microphones, or the like, not shown, and a microphone signal is delivered to a sensor unit 25, which in the system 10 is an aircraft flying over a body of water. The water surface is shown by reference numeral 30. A sensor unit operator, inside the aircraft, may then listen to the microphone signal or digitally analyze the microphone signal to determine if the sound detected by the microphones could be a submerged submarine.

A tow line 35 extends between the acoustic array 20 and a positive buoyancy float device 40, which as shown in FIG. 1, is towed along the water surface 30 by the underwater vehicle 15. A radar reflective target 45 is attached to the float device 40 and towed along the water surface 30 by the float device 40. The radar reflective target 45 is configured to simulate the radar signature of a submarine mast. The RCS of the radar reflective target may be larger or smaller by lengthening or shortening the radar reflective target 45.

FIG. 2 depicts the same target system 10 but shows the float device 40 and radar reflective target 45 being towed submerged under the water surface 30 at a depth D. In this case the sensor unit 25 is searching for a submarine operating at a greater depth and the underwater vehicle 15 may be programmed to set various depths D to train operators to locate submerged submarines operating at different depths.

In contrast to conventional submarine mast simulators, the radar reflective target 45 of the present invention is towed horizontally behind the float device 40. In radar tests conducted by applicant, the horizontally disposed radar reflective target 45 is detectable by conventional radar systems and provides a low cost alternative to the more complex vertically extended radar reflective targets of the prior art.

The sensor unit 25 is configured with a radar system such as an x-band or short wave radar system capable of generating high resolution target images on a display screen. X-band radar systems are typically used in civil, military and government institutions for weather monitoring, air traffic control, maritime vessel traffic control, defense tracking, and vehicle speed detection for law enforcement. Generally, the radar system emits a radar beam and detects portions of the radar beam that are reflected from radar reflective objects. The reflected portions of the radar beam are detected by the radar system and generate electrical signals that may be processed to generate a radar blip depicted on a display screen. Alternately, objects detected by the radar system may provide to an operator by other user interface feedback elements. Based on user interface feedback elements a radar operator may be able to decipher the object location, size, shape, distance, velocity and travel direction. A radar operator viewing the display screen or otherwise deciphering the radar feedback may then decide if the radar blip is characteristic of a submarine mast and take appropriate action.

Accordingly, the target system 10 generates an acoustic sound characteristic of a submerged submarine and provides a radar reflective target 45 having an RCS characteristic of a submarine mast. In addition, the underwater vehicle 15 may be programmed to tow the acoustic array 20 and radar reflective target 45 to simulate a submarine operation, e.g. moving at typical submarine velocities and depths to provide a realistic training environment for training aircraft sensor crews in submarine warfare techniques. Moreover, the improved target system 10 of the present invention allows a sensor crew to conduct both acoustic and radar training during a single aircraft pass-by. Of course, other submarine simulating elements may also be added to the target system 10.

Radar Reflective Target

Figure 3A:
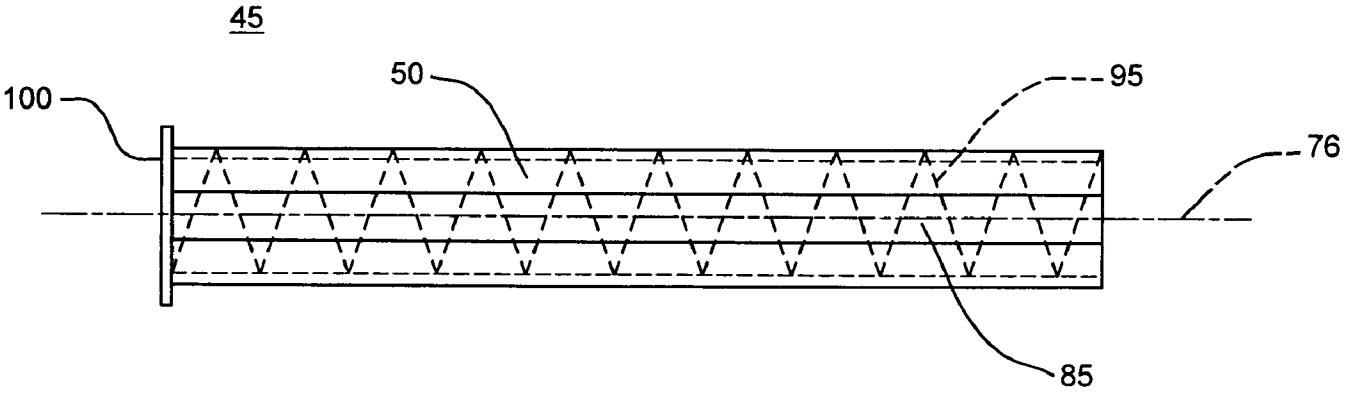
FIG. 3A illustrates a side view of a hollow tube-shaped radar reflective target according to the present invention.
Figure 3B:
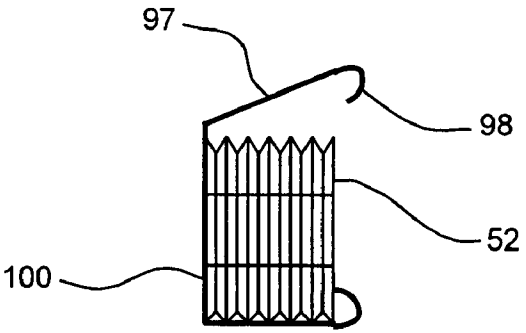
FIG. 3B illustrates a side view of the hollow tube-shaped radar reflective target in a collapsed state according to the present invention.
Figure 3C:
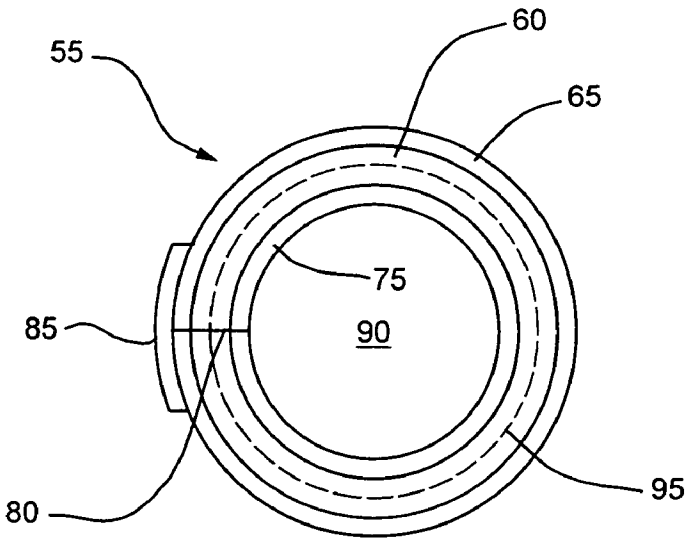
FIG. 3C illustrates an expanded end view of a hollow tube-shaped radar reflective target according to the present invention.

Referring to FIGS. 3A-3C, a preferred embodiment of the radar reflective target 45 comprises a hollow tube-shaped element 50 having a multilayered annular wall 55. The annular wall 55 includes a positive buoyancy layer 60. The positive buoyancy layer 60 preferably comprises a rectangular shaped layer of pliable plastic air cellular cushioning material. The plastic air cellular cushioning material comprises a plastic substrate formed with regularly spaced apart protruding air-filled hemispheres ("bubbles") that collectively provide positive buoyancy in water. One example of a commercially available material is BUBBLE WRAP™ sold by the Sealed Air Corporation of Elmwood Park N.J., USA. Preferably the positive buoyancy layer 60 has a thickness ranging from about 2-20 mm, but other thicknesses are usable. Alternately, the positive buoyancy layer 60 may comprise a pliable layer of other positive buoyancy plastic materials or composites.

The annular wall 55 further includes an externally facing radar reflective layer 65. The radar reflective layer 65 preferable comprises a rectangular shaped layer of a pliable radar reflective foil such as a metal or metalized foil. An aluminum foil having a thickness in the range of 0.5-2.5 mm is particularly suitable. In the present example, the aluminum foil layer 65 is sized to match the size and shape of the positive buoyancy layer 60 and is adhesively bonded thereto over an entire surface of the layer 60. To facilitate bonding, the aluminum foil layer 65 may be manufactured with one side of the layer being coated with an adhesive layer that is covered by a peel off protective sheet. The peel off sheet may then be removed just prior to contacting the radar reflective layer with a surface of the layer 60 and pressed on to ensure contact over the entire surface area.

In addition to the externally facing radar reflective layer 65, the annular wall may further comprise a second opposing internally facing radar reflective layer 75 having substantially the same characteristics and being similarly formed and attached to an opposing surface of the positive buoyancy layer 60 as the first radar reflective layer 65. The second radar reflective layer 75 may further increase the radar visibility of the annular wall 55.

In an alternative embodiment, the radar reflective layers 65 and 75 may be spayed, painted or otherwise deposited onto surfaces of the positive buoyancy layer 60. In one example, the radar reflective layers 65 and 75 may comprise a polyester or nylon film that is aluminized by evaporating a thin film of metal onto it. Such films reflect up to 99% of light, including much of the infrared spectrum and radar wavelengths.

The hollow tube-shaped element 50 is formed into a tube shape along a longitudinal axis 76 by rolling the pliable composite rectangular sheet about the longitudinal axis and contacting opposing longitudinal edges as shown by the seam 80 in FIG. 3C. The seam 80 is taped along its longitudinal length by a tape layer 85 to hold the tube shape. The hollow tube element 50 is thereby formed with open ends to allow air to readily flow through the circular hollow cross-section 90 as the tube is towed along the water surface or to allow water to readily flow through the circular hollow cross-section 90 as the tube is towed submerged. The hollow cross-section 90 reduces drag resistance and allows the hollow cross-section to contain air while being towed along the surface and the air contained therein further increases the positive buoyancy of the target 45.

The target 45 may also comprise one or more circular support members 95 disposed uniformly spaced apart along its longitudinal length for maintaining the tube shape. The support members 95 may comprise a one piece spirally formed wire member such as a weak compression spring, or the support members may comprise a plurality of spaced apart individual wire rings formed with circular cross-sections. In either configuration, the support members 95 may be formed from metal wire flat metal strips, from plastic material or any other suitable material.

In one embodiment, a spiral spring member is formed with an external diameter matching a desired tube external diameter and the pliable composite rectangular sheet is tightly wrapped around the spiral spring outside diameter and held in place by a contact force between the tube inside diameter and the spiral member. In other examples, a plurality of flat flexible strips are secured to the pliable composite rectangular sheet prior to forming the tube shape and the flat strips are formed into round hoops by the tube forming step. In any case, the support members 95 are secured to any surface of the pliable composite rectangular sheet or the formed tube either by mechanical or adhesive means.

In addition, the tube shaped target 45 also includes an attaching member 100 for attaching the target 45 to the float device 40 or to any tow line as may be required. The attaching member 100 may comprise an annular flange, a rod or other attaching element secured to the tube shaped target 45 at two or more points either by mechanical or adhesive attaching means. The attaching member 100 is configured to maintain the circular cross-section of a leading end of the hollow tube shaped element 50 to prevent the leading end from closing as water or air flows in.

According to a further aspect of the tube-shaped radar reflective target 45, the hollow element 50 is collapsible in an accordion-like fashion to reduce its longitudinal length to a storage length. The collapsed tube 52 is shown in side view in FIG. 3B. As depicted therein the collapsed tube 52 may be secured in the collapsed condition by a pair of opposing holding element 97, attached to the attaching member 100 and extend from the attaching member to the distal end of the collapsed tube to hold the tube in the collapsed state. The holding elements 97 may comprise a elasticized cord member configured with a hook shaped end 98 for capturing the collapsed tube distal end in the hook shaped end 98. Alternately other mechanical hooking or latching members are usable.

Generally the tube-shaped radar reflective target 45 is constructed with a desired RCS, which in the present embodiment is approximately 0.5-1.0 square meters. To achieve the desired RCS, the external diameter of the tube-shaped element 50 of approximately 150 mm is selected, and this dictates a longitudinal length of the tube-shaped element 50 of approximately 3.3 meters to provide a 0.5 square meter RCS, and a longitudinal length of 6.6 meters to provide a 1.0 square meter RCS. Alternately, the tube-shaped element 50 may be formed with other diameter and length combinations to provide any desired RCS.

Figure 4B:
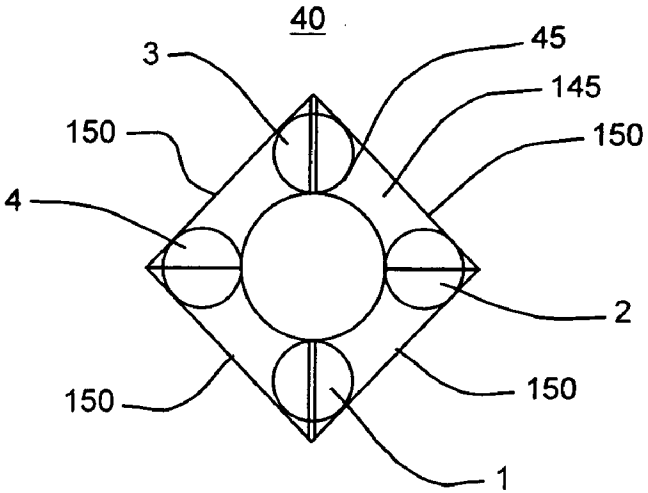
FIG. 4B illustrates a rear view of a floatation device including an optional storage box according to one embodiment of the present invention.
Figure 4C:
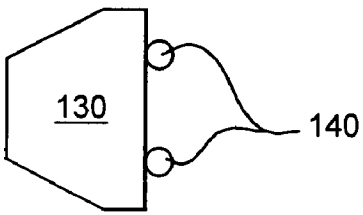
FIG. 4C illustrates a side view a floatation device stabilizer fin according to the present invention.
Figure 4A:
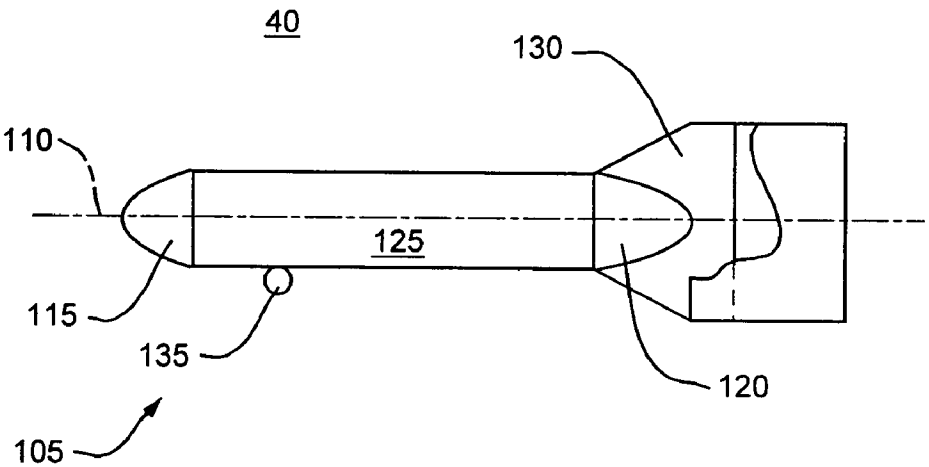
FIG. 4A illustrates a side view of a floatation device including an optional storage box according to the present invention.

Referring now to FIGS. 4A-4C, an assembled float device 40, according to the present invention, is shown in side view in FIG. 4A. The float device 40 comprises a hydrodynamically shaped shell 105 extending along a central longitudinal axis 110. The shell includes a forward facing conical nose portion 115 and a rearward facing conical tail portion 120 each attached to opposing ends of a cylindrical float section 125. The float section 125 comprises a positive buoyancy material such as a formed polystyrene foam element but also comprise wood or any other suitable positive buoyancy material. The tail portion 120 is equipped with a plurality of stabilizer fins 130. In a preferred embodiment, two orthogonal stabilizer fins 130 attach to the tail portion 120 and extend radially out from the longitudinal axis 110. The general shape and size of an example stabilized fin 130 is shown in side view in FIG. 4C which show a fin with a transverse height of 279 mm, (11 inches).

The float device 40 also includes a tow line attaching element 135, attached to the shell 105 on the submerged side of the longitudinal axis at a position along the longitudinal length that provides good towing performance. In addition, other attaching elements 140 are attached to stabilizer fins 130 as required for attaching one or more radar reflective targets 45 to the floatation device 40. The targets 45 may be attached by securing the target attaching member 100 directly to the attaching elements 140 or a tow line may be extended between the target attaching member 100 and the float attaching members 140.

As shown in side view in FIG. 4A and in rear view in FIG. 4B, the float device 40 may also include an optional box-shaped hollow storage area 145. The storage area 145 is formed by four walls 150 joined at common edges and attached to each of the stabilizer fins 130. The walls 150 may be square or rectangular and extend the longitudinal length of the float device 40 to provide the storage area 145. The storage area 145 is used to store one or more reflective target elements 45 therein. The stored target elements 45 are clamped with the tube-shaped element in the collapsed state 52 by the holding elements 97 which are configured to fit the collapsed tube 52 within in the length of the hollow storage area 145. As shown in FIG. 4B, collapsed tube-shaped elements 52 may be stored within the storage area 145 at orientations that are more radially distal from the longitudinal axis 110 than the external diameter of the cylindrical float section 125. This allows air or water to flow through collapsed tube-shaped elements 52 as the float device 40 is towed. Accordingly, a single float device may carry two radar reflective targets of similar or differing target characteristics and deploy the targets one at a time to vary the target characteristics during different phases of target training.

As further illustrated by FIG. 4B, radar target elements may be attached to the float device 40 at any of four positions, labeled 1-4. In position 1, the target leading end is always submerged and therefore position 1 is suitable as a storage position. In either of positions 2 and 4, the target leading end is substantially half submerged when the float device 40 is being towed along the water surface 30, shown in FIG. 1. In the case when the float device longitudinal axis 110 floats substantially coplanar the water surface 30, the leading ends of the targets in positions 2 and 3 intake about half water and half air. The positions 2 and 4 may be usable for either stored or deployed radar targets. In position 3, the target leading end is always above the water surface 30 such that the leading end takes in air. The intake air adds to the positive buoyancy of the target 45. The position 3 is the preferred position for deploying a tube shaped element 50.

Figure 5:
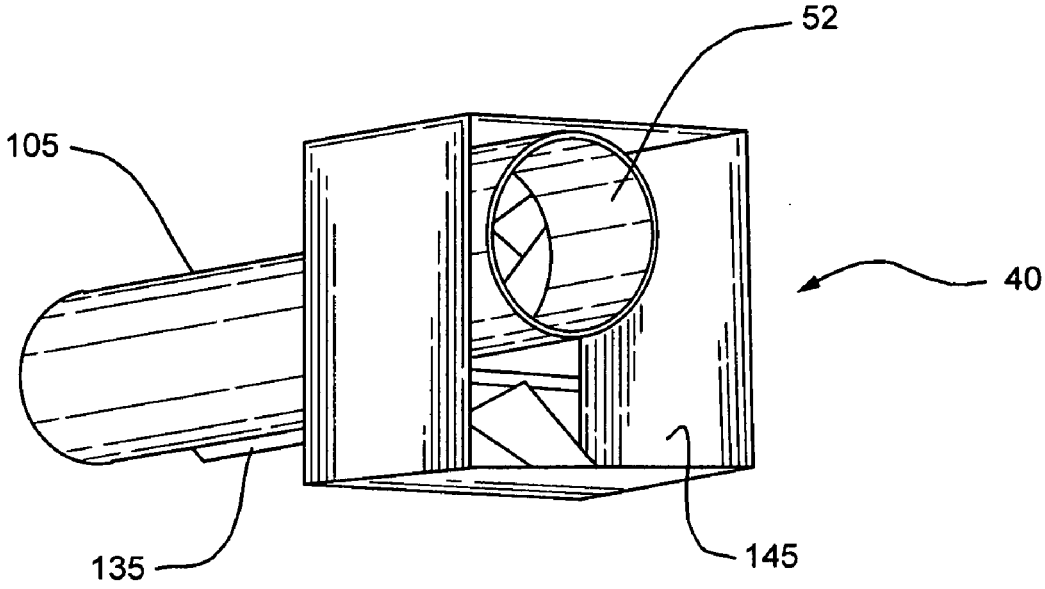
FIG. 5 illustrates an isometric rear view of a flotation device configured with an optional storage box having a collapsed hollow tube-shaped radar reflector stored inside according the present invention.
Figure 6:
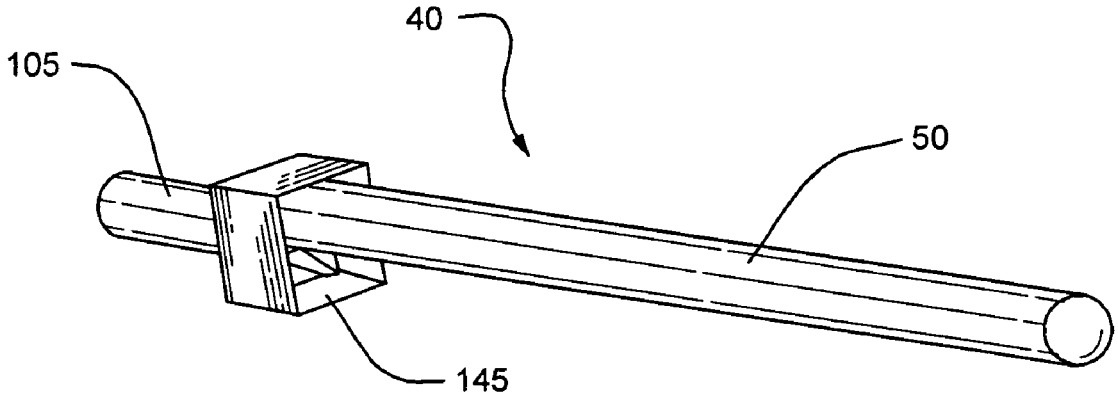
FIG. 6 illustrates an isometric rear view of a flotation device configured with an optional storage box having an operating hollow tube-shaped radar reflector extending there from according to the present invention.

Referring to FIG. 5 a float device 40 is shown in a rear isometric view to depict the optional storage area 145 shown with a collapsed tube-shaped element 52 stored therein. Referring to FIG. 6 a float device 40 is shown in a rear isometric view to depict the device with a fully extended tube shaped radar element 50 extending out from the storage area 145. Air enters the tube-shaped radar element (50) and provides buoyancy. However, when the float device 40 is pulled down into the water by the underwater vehicle 15, the tube-shaped radar element 50 fills with water thereby losing buoyancy resulting in the radar reflective target 45 sinking without the need for fins or additional power to assist in the sinking.

Stationary Tube-Shaped Radar Reflective Target

Figure 7:
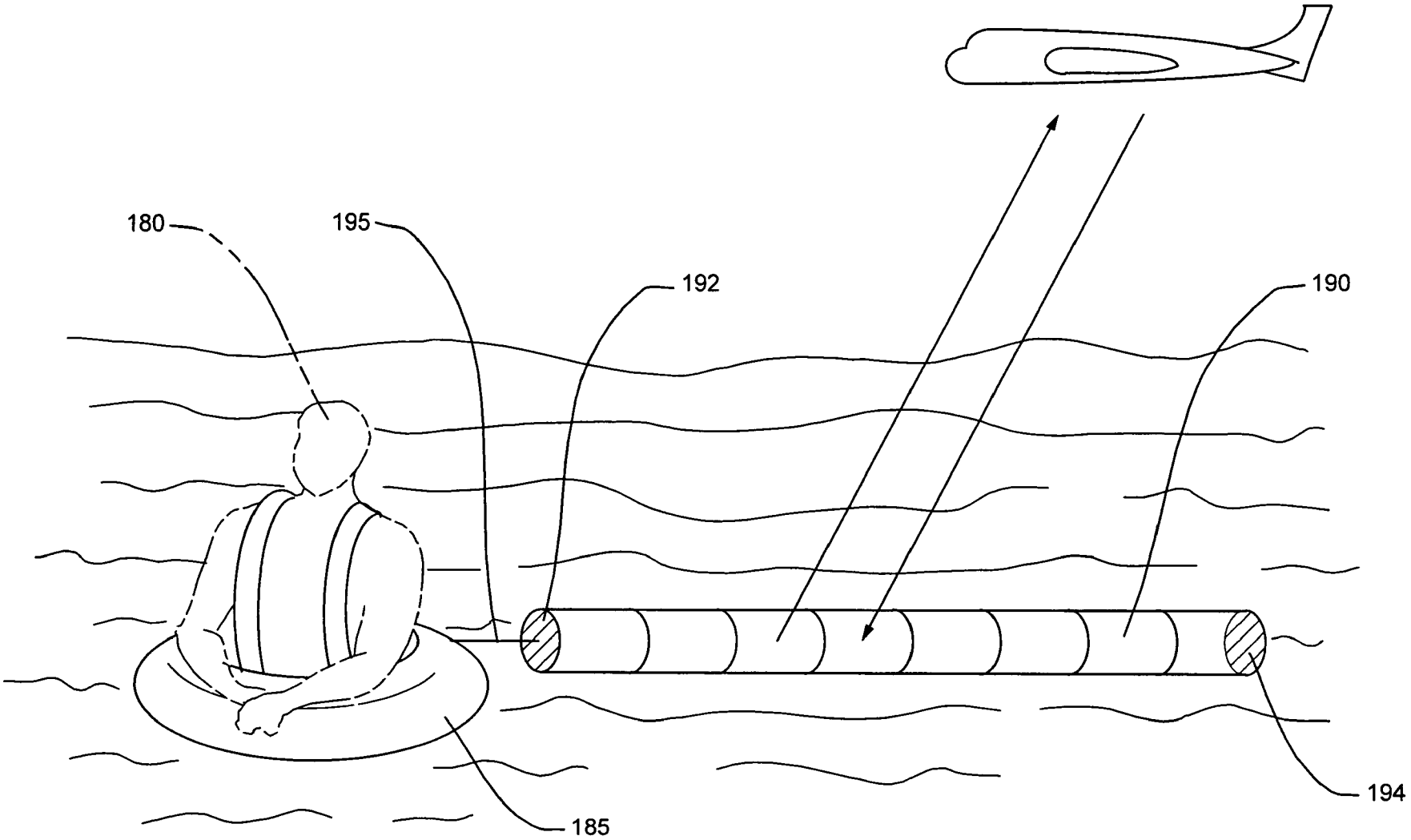
FIG. 7 illustrates a stationary hollow tube-shaped radar reflector configured with end caps and deployed from a floatation device according to the present invention.

Referring to FIG. 7, another embodiment of the present invention depicts a distressed person 180 floating in a body of water. The person 180 may be a crew member from a marine vessel or a downed aircraft. As shown, the person 180 is supported by a flotation device 185. The flotation device 185 may comprise a life jacket, survival suit, life raft or any other flotation device as may be used by the person 180. As further illustrated in FIG. 7, a substantially stationary tube-shaped radar reflective target 190 is attached to flotation device 185 by an attaching line 195 or other attaching device and deployed to float on the water surface proximate to the floatation device 185.

One embodiment of the stationary tube-shaped radar reflective target 190 comprises an annular wall and an attaching member 100 that are substantially identical in construction to the annular wall 55 and attaching member 100 shown in FIG. 3A. However, the stationary tube-shaped radar reflective target 190 further includes ends caps 192 and 194 attached to the open ends of the annular wall 55 to water seal each end of the hollow cross-section 90. The end caps 192 and 194 may comprise circular disks adhesively bonded or mechanically attached to each end of the annular wall 55 and provided to prevent the hollow cross-section 90 for filling with water. The end caps 192 and 194 may also include a valve passage usable to fill the tube with air or gas such as from a container of compressed gas, with a hand held air pump or by mouth blowing air into the tube. Like the hollow tube shaped element 50, shown in FIG. 3A, the stationary tube-shaped radar reflective target 190 can be stored in the collapsed state, like the collapsed tube 52 of FIG. 3B, e.g. inside a bag or case attached to the floatation device 185. Moreover, the stationary tube-shaped radar reflective target 190 may be automatically or manually deployed.

In an alternate embodiment, the stationary tube-shaped reflective target 190 may comprise a unitary single piece of seamless material forming an inflatable element. The inflatable element may comprise a continuous cylindrically formed outer skin having a circular cross-sections closed at each end by circular end cap section formed integrally therewith. The cylindrically formed outer skin and end caps surround a sealed hollow cavity. A fill valve, not shown, passes through the skin for delivering an air or gas into the sealed hollow cavity. The air or gas may be delivered through the valve with a container of compressed gas, by a hand held air pump or by mouth blowing air into the inflatable element.

The inflatable element may be formed from a metalized polyester or nylon material. The polyester material may comprise a biaxially oriented polyethylene terephthalate (bo-PET), know as MYLAR™ or MELINEX™. In either case, external surfaces of the inflatable element are aluminized by evaporating a thin film of metal thereon. Such a metalized film reflects up to 99% of light, including much of the infrared spectrum and radar wavelengths. In this embodiment, neither the continuous cylindrically formed outer skin or the end caps are formed from a positive buoyancy layer but instead the positive buoyancy is provided by filling the sealed hollow cavity with gas or air. Like the hollow tube shaped element 50 of FIG. 3A, the inflatable element can be stored in a collapsed state, like the collapsed tube 52 of FIG. 3B, e.g. inside a bag or case attached to the floatation device 185. Moreover, the inflatable element may be automatically or manually deployed.

Accordingly, the stationary tube-shaped radar reflective target 190 is filled with gas or air to cause it to float higher on the water surface to increase its radar visibility. In addition, the radar target 190 is beneficially configured with an easily detectable RCS such as an RCS of 2 or more square meters. Accordingly, the stationary tube-shaped radar reflective target 190 may be constructed with a diameter in the range of e.g. 300-600 mm and a longitudinal length e.g. 6-10 meters. Of course other diameter and length combinations as well as larger or smaller RCS dimensions are usable.

Stationary Flat Radar Reflective Target

Figure 8:
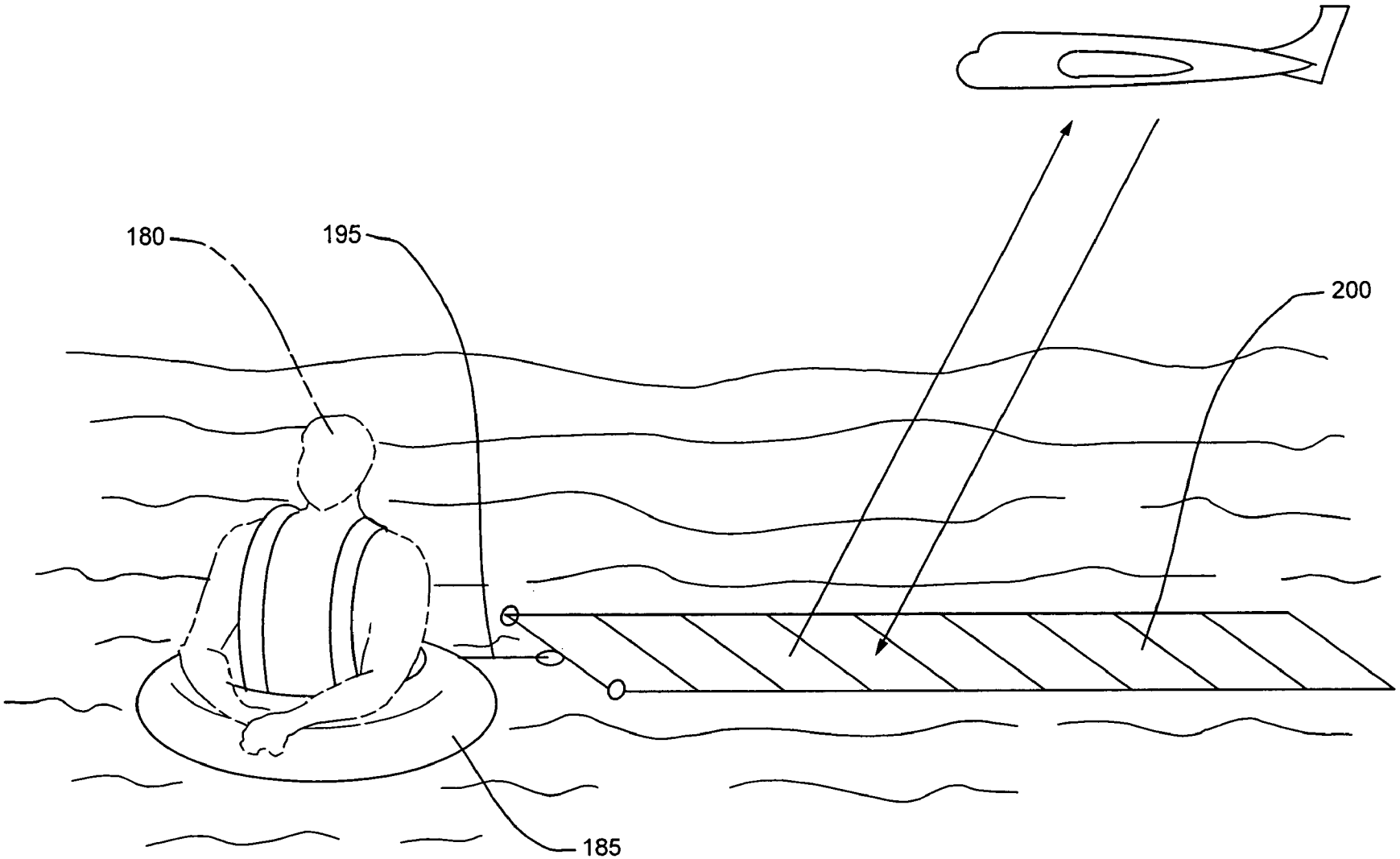
FIG. 8 illustrates a stationary flat rectangular-shaped radar reflector deployed from a floatation device according to the present invention.

A further embodiment of the present invention is illustrated in FIG. 8 which depicts a distressed person 180 floating in a body of water. The person 180 may be a crew member from a marine vessel or a downed aircraft. As shown, the person 180 is supported by a flotation device 185. The flotation device 185 may comprise a life jacket, survival suit, life raft or any other flotation device as may be used by the distressed person 180. As further illustrated in FIG. 8, a flat pliable radar reflective target 200 is attached to the flotation device 185 by an attaching line 195 and deployed to float on the water surface proximate to the floatation device 185 in a substantially stationary position.

Figure 9A:
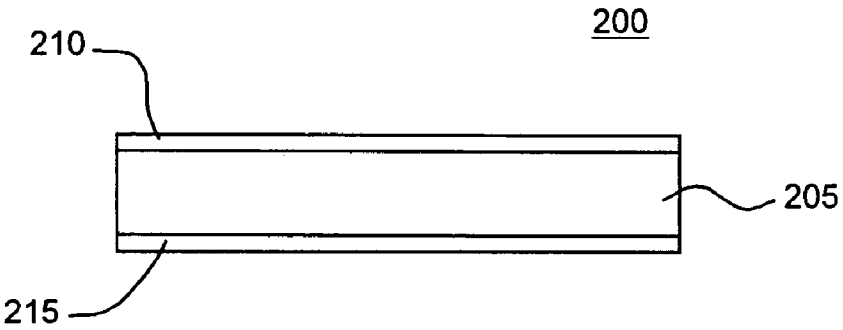
FIG. 9A illustrated a section view taken through a stationary flat rectangular-shaped radar reflector according to the present invention.

Referring to FIGS. 9A-9D, a flat pliable radar reflective target 200 according to the present invention is shown in section view in FIG. 9A. The target 200 comprises a positive buoyancy layer 205 preferably comprising a rectangular shaped layer of pliable plastic air cellular cushioning material. The air cellular cushioning material is formed with regularly spaced apart protruding air-filled hemispheres ("bubbles") that collectively provide positive buoyancy in water. Preferably the positive buoyancy layer 205 has a thickness ranging from about 2-20 mm but other thicknesses are usable. One example of a commercially available air cellular material is BUBBLE WRAP™ sold by the Sealed Air Corporation, of Elmwood Park N.J., USA. Alternately, the positive buoyancy layer 60 may comprise any pliable layer of positive buoyancy material or composite.

The flat pliable radar reflective target 200 further includes a skyward facing radar reflective layer 210. The radar reflective layer 210 preferable comprises a rectangular shaped layer of a pliable radar reflective foil such as a metal or metalized foil. An aluminum foil having a thickness in the range of 0.5-2.5 mm is particularly suitable. In the present example, the aluminum foil layer 210 is sized to match the size and shape of the positive buoyancy layer 205 and is adhesively bonded thereto over its entire surface. To facilitate bonding, the aluminum foil layer 210 may be manufactured with one side of the layer being coated with an adhesive layer that is covered by a peel off protective sheet. The peel off sheet may then be removed just prior to attaching the two sheets together.

In addition to the skyward facing radar reflective layer 210, the flat pliable radar reflective target 210 may further comprise a second opposing seaward facing radar reflective layer 215 having substantially the same characteristics and being similarly formed and attached to an opposing surface of the positive buoyancy layer 205 as the radar layer 210. The second layer 215 may further increase the radar visibility of the target 200 and is especially advantageous when sea and wind conditions may flip the target 200.

In alternate embodiments, the radar reflective layers 210 and 215 may be spayed, painted or otherwise deposited onto surfaces of the positive buoyancy layer 205. In one example, the radar reflective layers 210 and 215 may comprise a polyester or nylon film that is aluminized by evaporating a thin film of metal onto it. Such films reflect up to 99% of light, including much of the infrared spectrum and radar wavelengths.

Figure 9B:
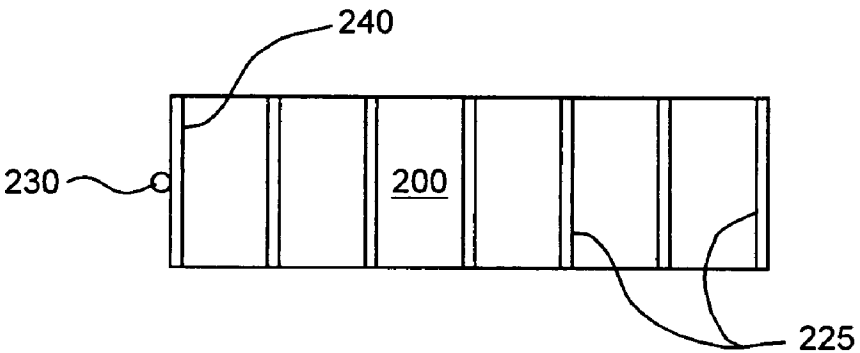
FIG. 9B illustrates a stationary flat rectangular-shaped radar reflector configured with a plurality of transverse stiffening members according to the present invention.
Figure 9C:
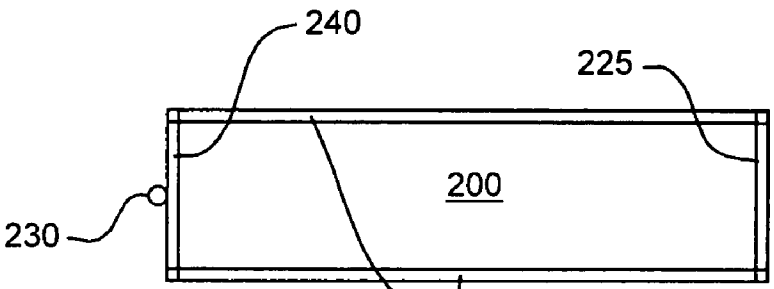
FIG. 9C illustrates a stationary flat rectangular-shaped radar reflector configured with two longitudinal stiffening members according to the present invention.

As shown in FIGS. 9B and 9C, the flat pliable radar reflective target 200 may be configured with one or more longitudinal stiffening members 220 and or with one or more transverse stiffening members 225. The stiffening members 220 and 225 may be attached to or integrally formed with the positive buoyancy layer 205 and may comprise a positive buoyancy material such as wood. The stiffening member 220 and 225 function to keep the flat pliable radar reflective target 200 deployed in a flat state to ensure that the full RCS of the target is always facing skyward.

The longitudinal stiffening members 220 comprise flexible members such as a flat metal or plastic springs or flexures, as might be used as the tape of a retractile tape measure. The flat longitudinal springs or flexures 220 are configured to remain stiff and straight when the target 200 is deployed in the water but the longitudinal springs or flexures 220 can be snapped to a second state that allows the springs 220 to be spooled around a rod in a storage state.

The transverse stiffening members 225 comprise a plurality of rigid members such as rods or flat strips of plastic, wood, metal or any other suitable material disposed spaced apart along the longitudinal length of the flat target 200. Each of the stiffening members 220 and 225 may be attached to the flat target 200 by any adhesive or mechanical attaching means. In addition, the flat radar target 200 includes an attaching element 230 for securing the target 200 to the floatation device 185 by a two line or other attaching hook or the like.

Figure 9D:
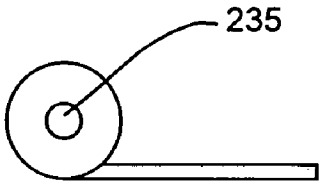
FIG. 9D illustrates an end or side view of a flat rectangular-shaped radar reflector rolled around a take-up rod.

The flat pliable radar reflective target 200 may be rolled for storage in a compact. One storage example is shown in FIG. 9D which depicts a take-up rod 235 usable for wrapping the longitudinal length of flat radar target 200 around in a compact roll. The take up rod 235 may comprise a first end transverse stiffening member 240 or a separate take-up rod may be attached to the floatation device 185.

The flat pliable radar reflective target 200 may have any combination of dimensions that provides a desired RCS, e.g. 2 square meters. In one example a narrow transverse width of 150 mm is usable with a longitudinal length of 13.33 meters. In another example, a transverse width of 1 meter is usable with a longitudinal length of 2 meters. Alternately, the flat pliable radar reflective target 200 may be formed in other shapes, e.g. circular or triangular. In addition, the flat pliable radar reflective target 200 may be brightly colored for easy daylight visibility and or coated with a phosphor luminescence layer for easy night time visibility.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. as a radar training target, those skilled in the art will recognize that its usefulness is not limited thereto and that the present invention can be beneficially utilized in any number of environments and implementations where it is desirable to simulate the radar cross section of a target object or to increase the radar cross section of a target object. Accordingly, the claims set forth below should be construed in view of the full breadth and spirit of the invention as disclosed herein.

What is claimed is:

1. A method for simulating the radar profile of submarine mast comprising the steps of:

deploying an underwater vehicle under the surface of a body of water and moving the underwater vehicle at a typical submarine velocity;

towing a float device attached to the underwater vehicle behind the underwater vehicle, said float device having a leading end facing the tow direction and a trailing end opposed to the tow direction; and, towing a horizontally deployed positive buoyancy radar reflective target attached to the float device trailing end behind the float wherein the radar reflective target comprises a hollow tube-shaped element formed with an open leading end and an open trailing end along a longitudinal axis.

2. The method of claim 1 wherein the float device and radar reflective target are towed along the water surface.

3. The method of claim 1 wherein the float device and radar reflective target are towed submerged under the water surface.

4. The method of claim 2 further comprising the step of:

supporting the radar target open leading end substantially above the water surface during towing enabling air to enter the hollow tube-shaped radar target.

5. The method of claim 2 further comprising the step of:

supporting the radar target open leading end substantially half above the water surface during towing enabling air to enter a portion of the hollow tube-shaped element.

6. The method of claim 1 further comprising the step of storing a second positive buoyancy radar reflective target attached to the float device in a collapsed state.

7. The method of claim 1 further comprising the steps of:

towing an acoustic array attached to the underwater vehicle; and causing the acoustic array to emit an acoustic sound that simulates the sound made by a submarine.

8. The method of claim 1, further comprising:

expanding the hollow tube-shaped element from a collapsed configuration by allowing at least one of water and air to flow through the hollow tube-shaped element along at least a portion of the longitudinal axis from the open leading end toward the open trailing end.

9. The method of claim 8 further comprising:

storing the hollow tube-shaped element in the collapsed configuration using at least one holding element.

10. The method of claim 1 wherein the hollow tube-shaped element comprises at least one annular wall formed along at least a portion of the longitudinal axis.

11. The method of claim 10 wherein the at least one annular wall comprises at least one layer formed along at least a portion of the annular wall.

12. The method of claim 11 wherein the at least one layer comprises at least one rectangular sheet rolled along the longitudinal axis.

13. The method of claim 12 wherein the at least one rectangular sheet comprises a first rectangular sheet and a second rectangular sheet and a coupling element couples the first and second rectangular sheets.

14. The method of claim 11 wherein the at least one layer is a pliable radar reflective foil.

15. The method of claim 14 wherein the pliable radar reflective foil is one of a metal or a metalized foil.

16. The method of claim 11 wherein the at least one layer comprises a first externally facing radar reflective layer and a second internally facing radar reflective layer opposing the first externally facing radar reflective layer to increase the radar visibility of the hollow tube-shaped element.

* * * * *

UNITED STATES PATENT AND TRADEMARK OFFICE

CERTIFICATE OF CORRECTION

PATENT NO. : 7,671,783 B2
APPLICATION NO. : 11/601938
DATED : March 2, 2010
INVENTOR(S) : Carcone It is certified that error appears in the above-identified patent and that said Letters Patent is hereby corrected as shown below:

Abstract, line 5 delete "end" and replace with --ends--.

Column 1, line 16 delete "In a" and replace with --In--.

Column 2, line 11 delete "by in" and replace with --in--.

Column 2, line 46 delete "stabilized" and replace with --stabilize--.

Column 3, line 42 delete "view a" and replace with --view of a--.

Column 3, line 47 delete "according the" and replace with --according to the--.

Column 5, lines 38-39 delete "preferable" and replace with --preferably--.

Column 6, line 54 delete "element" and replace with --elements--.

Column 7, line 14 delete "comprise" and replace with --can comprise--.

Column 7, line 20 delete "show" and replace with --shows--.

Column 7, line 44 delete "within in" and replace with --within--.

Column 8, line 10 delete "(50)" and replace with --50--.

Column 8, line 55 delete "cross-sections" and replace with --cross-section--.

Column 8, line 66 delete ", know" and replace with --, known--.

Column 9, line 53 delete "preferable" and replace with --preferably--.

Column 10, line 22 delete "member" and replace with --members--.

Column 11, line 10 delete "of submarine" and replace with --of a submarine--.

Signed and Sealed this
First Day of February, 2011

David J. Kappos

David J. Kappos
*Director of the United States Patent and Trademark Office*